US006011516A

United States Patent [19]

Minegishi et al.

[11] Patent Number: 6,011,516

[45] Date of Patent: Jan. 4, 2000

[54] MULTIBAND ANTENNA WITH A DISTRIBUTED-CONSTANT DIELECTRIC RESONANT CIRCUIT AS AN LC PARALLEL RESONANT CIRCUIT, AND MULTIBAND PORTABLE RADIO APPARATUS USING THE MULTIBAND ANTENNA

[75] Inventors: Kazuo Minegishi; Shigeyoshi Yoshida, both of Sendai; Kenji Takamoro; Ryo Ito, both of Tokyo, all of Japan

[73] Assignees: Tokin Corporation, Miyagi; NEC Corporation, Tokyo, both of Japan

[21] Appl. No.: 08/739,183

[22] Filed: Oct. 30, 1996

[30] Foreign Application Priority Data

Oct. 31, 1995 [JP] Japan ..... 7-282818

[51] Int. Cl.[7] ..... H01Q 1/24

[52] U.S. Cl. ..... 343/702; 343/895; 343/722

[58] Field of Search ..... 343/702, 895, 343/749, 745, 722; 333/219, 222, 219.1, 206, 204; H01Q 1/24

[56] References Cited

U.S. PATENT DOCUMENTS

| | | | |
|---|---|---|---|
| 3,474,453 | 10/1969 | Ireland | 343/745 |
| 4,509,056 | 4/1985 | Ploussios | 343/791 |
| 5,023,866 | 6/1991 | DeMuro | 370/24 |
| 5,479,141 | 12/1995 | Ishizaki et al. | 333/204 |
| 5,539,363 | 7/1996 | Maruyama et al. | 333/206 |
| 5,748,154 | 5/1998 | Yokota | 343/702 |

FOREIGN PATENT DOCUMENTS

| | | |
|---|---|---|
| 0323726 A3 | 7/1989 | European Pat. Off. . |
| 0613207 A1 | 8/1994 | European Pat. Off. . |
| 0634806 A1 | 1/1995 | European Pat. Off. . |
| 5-121924 | 5/1993 | Japan . |

OTHER PUBLICATIONS

Patent Abstracts of Japan, vol. 95, No. 6, Jul. 31, 1995 & JP 07 086823 A (Kokusai Electric Co., Ltd.), Mar. 31, 1995.

*Primary Examiner*—Hoanganh Le
*Attorney, Agent, or Firm*—Frishauf, Holtz, Goodman, Langer & Chick, P.C.

[57] ABSTRACT

A multiband antenna comprises an antenna device which is resonant at two or more different frequencies. The antenna device comprises a first antenna rod (7), a second antenna rod (8), and a distributed-constant dielectric resonator which is a coaxial dielectric resonator (1A) comprising a dielectric block (1A1). The first antenna rod (7) is electrically connected to an inner conductor (4) covering the inner surface of the dielectric block (1A1). The second antenna rod (8) is electrically connected to an outer conductor (5) covering an outer periphery of the dielectric block (1A1). In another structure, the dielectric resonator is a triplate dielectric resonator (1B) comprising two dielectric plates (1B1). The first antenna rod (7) is electrically connected to a center conductor (6) interposed between the dielectric plates (1B1). The second antenna rod (8) is electrically connected to outer conductors (5) covering the dielectric plates (1B1) at the side opposite to the center conductor (6).

20 Claims, 17 Drawing Sheets

MULTIBAND ANTENNA WITH A DISTRIBUTED-CONSTANT DIELECTRIC RESONANT CIRCUIT AS AN LC PARALLEL RESONANT CIRCUIT, AND MULTIBAND PORTABLE RADIO APPARATUS USING THE MULTIBAND ANTENNA

BACKGROUND OF THE INVENTION

This invention relates to an antenna device for use in mobile radio communication and, in particular, to a multiband antenna capable of performing transmission and reception in a plurality of different frequency bands, and to a multiband portable radio apparatus using the multiband antenna.

Generally, a single antenna device is operable in a single frequency band. To use a radio apparatus in different frequency bands, the radio apparatus is generally required to have a plurality of antenna devices. A typical example is an FM/AM radio receiver.

On the other hand, there is known a trap antenna which is operable over a plurality of separate frequency bands. The trap antenna is often used in amateur radio communication as a multiband antenna.

A conventional trap antenna is disclosed in, for example, Japanese Unexamined Patent Publication (A2) No. 5-121924 (121924/1993).

The conventional trap antenna comprises two strip antenna elements and a resonant circuit or a trap circuit interposed therebetween. The resonant circuit comprises an inductance element (L) and a capacitance element (C) connected in parallel and is referred to as an LC parallel resonant circuit. The LC parallel resonant circuit used in the conventional trap antenna is of a lumped constant type.

However, the conventional trap antenna inevitably has a floating capacitance upon loading the trap circuit. This results in a difference between a theoretical resonant frequency and an actual or measured resonant frequency.

The conventional trap antenna also encounters another problem. Specifically, the trap circuit comprises a capacitor and a coil as the capacitance element and the inductance element, respectively. In addition, a substrate and a shield case are required to support and to shield the capacitor and the coil, respectively. Thus, the conventional trap antenna requires a number of components and assembling steps, and inevitably becomes large in size even though each individual component is small.

In the case where the conventional trap antenna with the above-mentioned structure is used as an external antenna of a radio apparatus, the external antenna is insufficient in strength because of inclusion of the trap circuit comprising the coil and the capacitor. When the radio apparatus is subjected to a mechanical shock, the external antenna is susceptible to damage. Such a disadvantage can result in a serious problem particularly in the case of a portable apparatus.

SUMMARY OF THE INVENTION

It is a general object of this invention to provide a multiband antenna which is small in size, which is improved characteristics, and which is resistant against mechanical shock. This is achieved by using a trap circuit which is free from a floating capacitance, easy to manufacture, and small in size.

It is also an object of this invention to provide a multiband antenna which requires a reduced number of components and assembling steps, and which can be economically manufactured in a simple process with a high efficiency.

It is another object of this invention to provide a multiband antenna which is excellent in mechanical strength.

It is still another object of this invention to provide a multiband antenna which has improved antenna characteristics with a reduced loss and, depending on the structure, capable of preventing leakage of an electromagnetic wave without using a metal case.

It is yet another object of this invention to provide a small-sized multiband mobile communication radio apparatus which includes a single antenna device but is capable of performing transmission and reception of radio signals in different frequency bands such as 800 MHz and 1.9 GHz.

A multiband antenna according to this invention comprises as a trap circuit an LC parallel resonant circuit implemented by a distributed-constant dielectric resonator.

Basically, the distributed-constant dielectric resonator can be realized by forming two conductor lines on a dielectric material.

According to this invention, the multiband antenna is manufactured by simply coupling mechanical components to one another.

According to this invention, the dielectric resonator and an antenna rod are molded in a molding material to form an integral structure.

DESCRIPTION OF THE PREFERRED EMBODIMENTS:

For a better understanding of this invention, a conventional trap antenna will at first be described with reference to FIG. 1.

Figure 1:
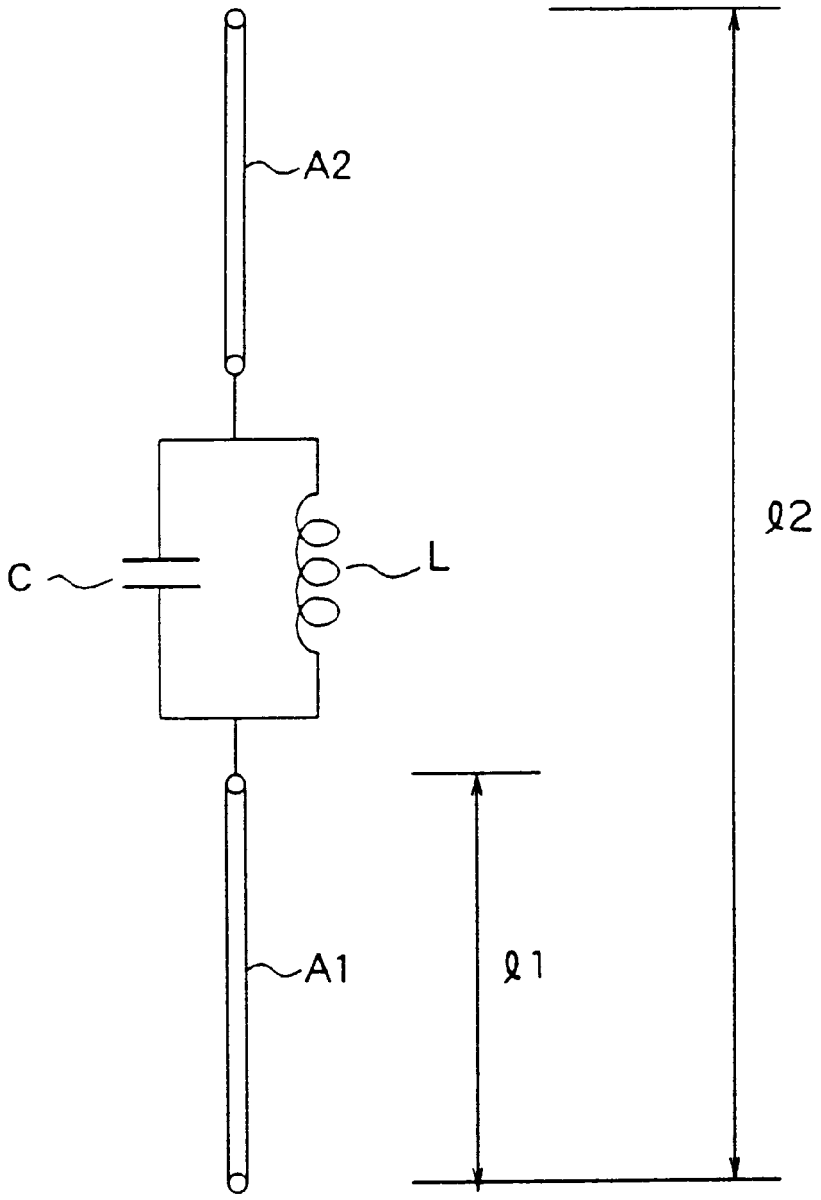
FIG. 1 (PRIOR ART)
FIG. 1 is a schematic view illustrating a conventional trap antenna.

Referring to FIG. 1, the conventional trap antenna comprises first and second strip antenna elements A1 and A2 and a trap circuit inserted therebetween. The trap circuit comprises an LC parallel resonant circuit including an inductance element L and a capacitance element C connected in parallel.

The trap antenna having the above-mentioned structure is resonant at two different frequencies under the conditions which will now be described.

A higher resonant frequency and a lower resonant frequency as desired are represented by $f_{HIGH}$ and $f_{LOW}$, respectively. The higher and the lower resonant frequencies $f_{HIGH}$ and $f_{LOW}$ correspond to wavelengths $\lambda_1$ and $\lambda_2$, respectively. That is:

$$f_{HIGH}=c/\lambda_1$$

$$f_{LOW}c/\lambda_2$$

Herein, c represents an electromagnetic constant or a light velocity. The first strip antenna element A1 has a length $\ell_1$ equal to $\lambda_1/2$. The trap circuit is designed to cause antiresonance at the higher resonant frequency $f_{HIGH}$. In this event, the trap antenna is resonant around the higher resonant frequency $f_{HIGH}$. On the other hand, for the lower resonant frequency $f_{LOW}$, the trap circuit designed to cause resonance at the higher resonant frequency $f_{HIGH}$ serves as a reactance. Resonance at the lower resonant frequency $f_{LOW}$ is established by adjusting a total length $\ell_2$ of a dipole antenna structure comprising the first and the second strip antenna elements A1 and A2 and the LC parallel resonant circuit. In this manner, the conventional antenna is resonant at the two different frequencies.

Now, description will be made as regards this invention with reference to FIGS. 2 through 25.

Figure 2:
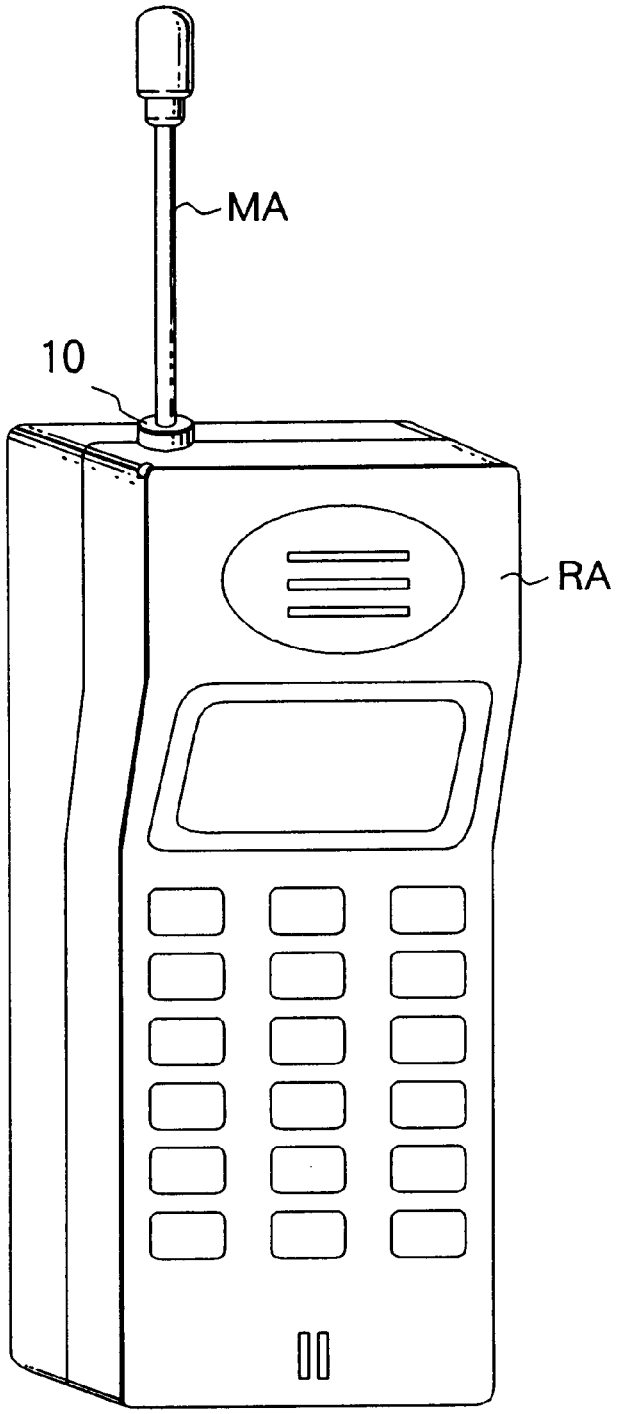
FIG. 2 is a perspective view of a multiband portable radio apparatus to which this invention is applicable.

This invention is applicable to a multiband antenna device MA of a portable radio apparatus RA illustrated in FIG. 2.

According to this invention, a trap circuit of the multiband antenna device MA comprises a distributed-constant dielectric resonator instead of a combination of the reactance element L and the capacitance element C in the conventional trap antenna.

In the following description, a coaxial dielectric resonator and a triplate dielectric resonator will be described as the distributed-constant dielectric resonator in conjunction with several preferred embodiments.

A multiband antenna using the coaxial dielectric resonator includes a wide range of variations depending upon various factors. For example, whether or not a center hole of a dielectric block of the coaxial dielectric resonator is a through hole, the manner how the dielectric block is covered with a conductor, the shape of an antenna element to be connected, the shape of a sleeve for fixing the dielectric resonator, and so on.

Likewise, a multiband antenna using the triplate dielectric resonator includes a wide range of variations depending upon various factors. For example, which portion is covered with a conductor, the shape of an antenna element connected to a center conductor, the relationship between the center conductor and an antenna rod, and so on.

Description will be made in detail as regards such a wide variety of embodiments with reference to the drawing.

First Embodiment

Referring to FIGS. 3 through 6, a multiband antenna according to a first embodiment will be described.

Figure 3:
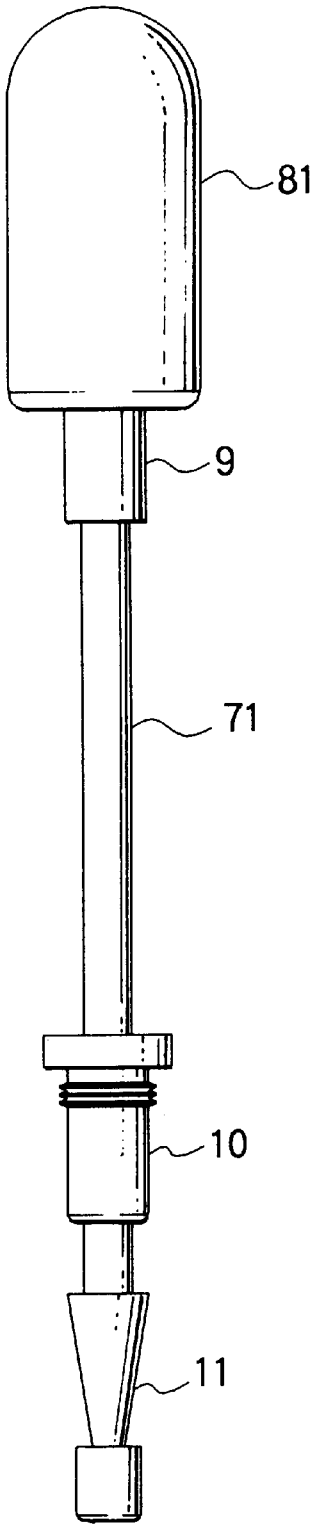
FIG. 3 is a front view of a multiband antenna according to an embodiment of this invention.
Figure 4:
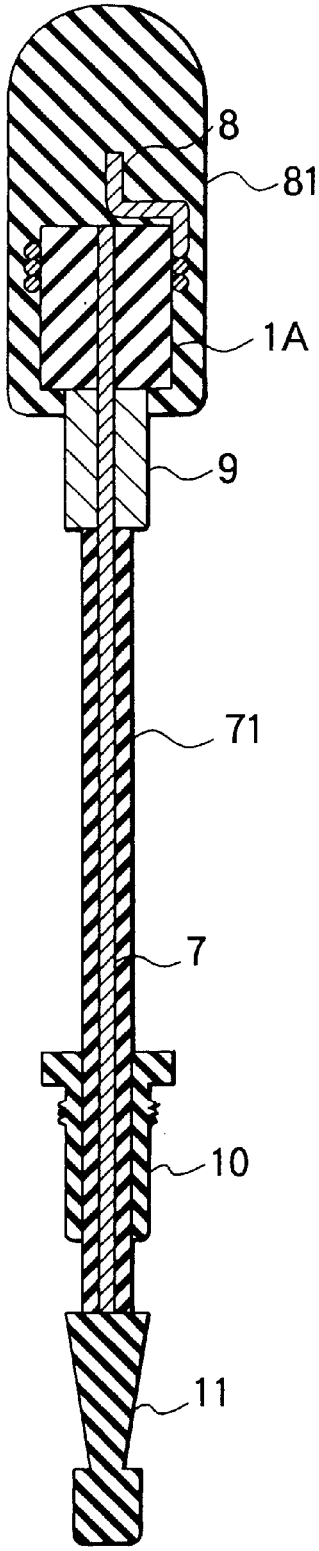
FIG. 4 is a sectional view of the multiband antenna of FIG. 3.

As illustrated in FIGS. 3 and 4, the multiband antenna according to the first embodiment comprises a coaxial dielectric resonator 1A, a first antenna rod 7, a second antenna rod 8, a molding portion 81, an urethane tube 71, a sleeve 9, a holder 10, and a stopper 11.

Figure 5:
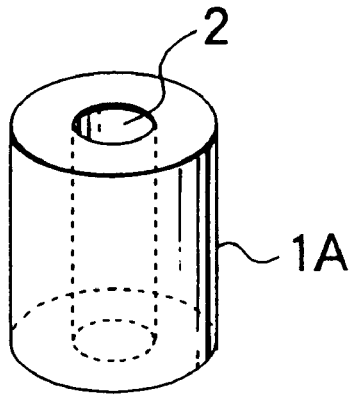
FIG. 5 schematically shows a perspective view of a dielectric block in first and second embodiments of this invention.
Figure 6:
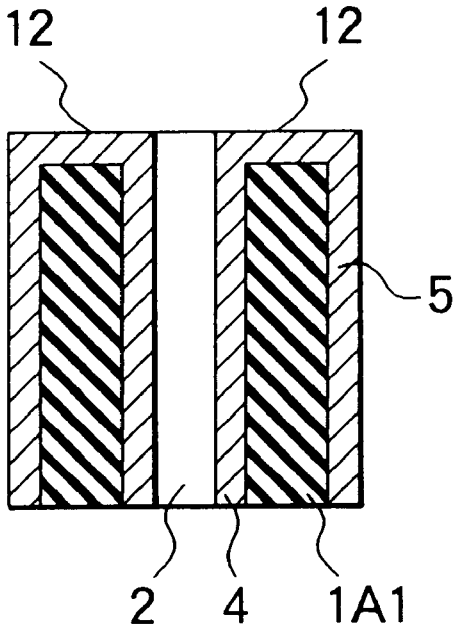
FIG. 6 is a sectional view of a coaxial dielectric resonator according to the first embodiment of this invention.

Referring to FIGS. 5 and 6 in addition, the coaxial dielectric resonator 1A comprises a dielectric block 1A1 having a center hole 2, inner and outer conductors 4 and 5 covering an inner surface and an outer peripheral surface of the dielectric block 1A1, respectively, and a top conductor 12 covering a top surface of the dielectric block 1A1.

The first antenna rod 7 is electrically connected to the inner conductor 4 while the second antenna rod 8 is electrically connected to the outer conductor 5.

The molding portion 81 encloses the second antenna rod 8 and the coaxial dielectric resonator 1A.

The urethane tube 71 covers the first antenna rod 7.

The sleeve 9 serves as a fixture for the coaxial dielectric resonator 1A, a protector for the tube 71, and a stopper upon retraction of the multiband antenna.

The holder 10 is for fixing the multiband antenna to a housing of, for example, a portable radio apparatus RA in FIG. 2.

The urethane tube 71 is inserted in and passes through the holder 10 so that the urethane tube 71 is frictionally slidably held by the holder 10.

When the multiband antenna is pulled out or extended from the apparatus, the stopper 11 is brought into contact with the holder 10 to restrict the protrusion of the multiband antenna within an appropriate range.

More specifically, the center hole 2 formed in the dielectric block 1A1 of the coaxial dielectric resonator 1A is a through hole in the first embodiment. The inner, the outer, and the top conductors 4, 5, and 12 cover the inner surface, the outer peripheral surface, and the top surface of the dielectric block 1A1, respectively. The coaxial dielectric resonator 1A has a short-circuited end at the top end because the inner and the outer conductors 4 and 5 are connected by the top conductor 12. The sleeve 9 has a cylindrical shape. The first antenna rod 7 is inserted into the through hole 2 of the dielectric block 1A1 from a bottom surface which is exposed without any conductors to form an open-circuit end of the coaxial dielectric resonator. The first antenna rod 7 reaches a position where a top end of the first antenna rod 7 is flush with the top conductor 12 on the top surface of the dielectric block 1A1. At that position, the first antenna rod 7 is connected by soldering or the like to the inner conductor 4. The second antenna rod 8 has a portion wound around the outer conductor 5 and electrically connected to the outer conductor 5 by soldering or the like. A remaining portion of the second antenna rod 8 extends along an axis of the first antenna rod 7. The second antenna rod 8 is electrically connected also to the first antenna rod 7 through the top conductor 12. The coaxial dielectric resonator 1A is a λ4 resonator in a TEM mode because of provision of the open-circuit end at its one end.

The multiband antenna is also operable as a triple-frequency resonant antenna if it is used in a communication system using different frequency bands one of which is substantially equal to an even-numbered integral multiple of another.

For example, it is assumed that the different frequency bands $f_{HIGH}$, $f_{LOW1}$, and $f_{LOW2}$ are equal to 1.9 GHz, 820 MHz, and 950 MHz, respectively. In this event, the following relationship holds:

$$\lambda_{HIGH}/2=\lambda_{LOW2}/4$$

Like the conventional antenna in FIG. 1, the first antenna rod 7 has a length $\ell_1$ and the multiband antenna has a total length $\ell_2$. These lengths are selected as follows:

$$\ell_1=\lambda_{HIGH}/2=\lambda_{LOW2}/4$$
$$\ell_2=\lambda_{LOW2}/2$$

Thus, the triple-frequency resonant antenna is achieved. In this example, the frequency bands $f_{LOW1}$ and $f_{LOW2}$ have transmission and reception can not be carried out by a single antenna device unless it is a broad-band antenna device. According to this invention, transmission and reception can be performed by the multiband antenna as a single antenna device not only in two different frequency bands requiring such a broad-band antenna but also in another additional frequency band. This also applies to other embodiments which will hereafter be described. In the foregoing, the lengths of $\ell_1$ and $\ell_2$ are equal to λ /2 and λ /4 for convenience of description. However, it will be understood that the lengths may be changed to any appropriate values, for example, 3λ/8.

Second Embodiment

Figure 7:
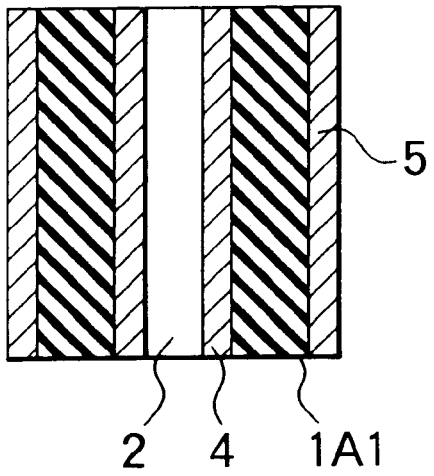
FIG. 7 is a similar sectional view of a coaxial dielectric resonator according to the second embodiment of this invention.

Next, description will proceed to a second embodiment of this invention with reference to FIGS. 5 and 7.

In the second embodiment, a trap circuit comprises a λ /2 coaxial dielectric resonator 1A in the TEM mode with open-circuited top and bottom ends. The structure is basically similar to that of the first embodiment and the following description will be directed to characteristic portions of a multiband antenna according to the second embodiment.

Referring to FIG. 7, a coaxial dielectric resonator 1A has a dielectric block 1A1 with a through hole 2, and inner and outer conductors 4 and 5 covering an inner surface and an outer peripheral surface of the dielectric block 1A1, respectively. But the top and the bottom surfaces are not covered with any conductors so that the inner and the outer conductors 4 and 5 are open-circuited at both ends. A sleeve 9 also has a cylindrical shape. A first antenna rod 7 is inserted into the through hole 2 of the dielectric block 1A1 from its bottom open-circuited end. The first antenna rod 7 reaches a position where a top end of the first antenna rod 7 is flush with the top open-circuited end of the dielectric block 1A1. At that position, the first antenna rod 7 is connected by soldering or the like to the inner conductor 4 at a position. On the other hand, a second antenna rod 8 has a portion wound around the outer conductor 5 and electrically connected to the outer conductor 5 by soldering or the like. A remaining portion of the second antenna rod 8 extends along an axis of the first antenna rod 7. The coaxial dielectric resonator 1A is a λ /2 resonator which provides a low-loss multiband antenna although it is slightly greater in size.

Figure 8:
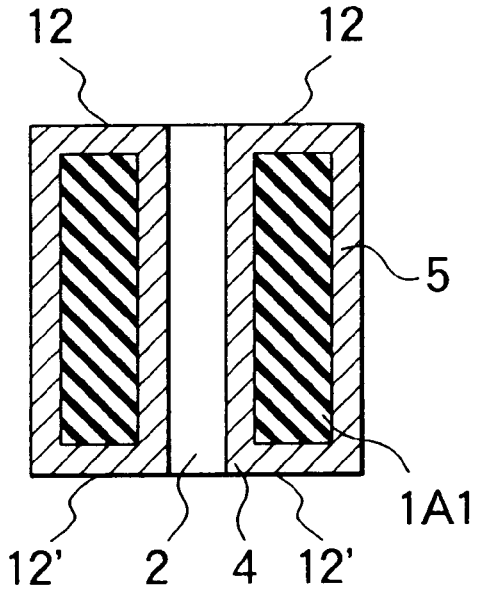
FIG. 8 is a similar sectional view of another coaxial dielectric resonator according to the second embodiment of this invention.
Figure 9:
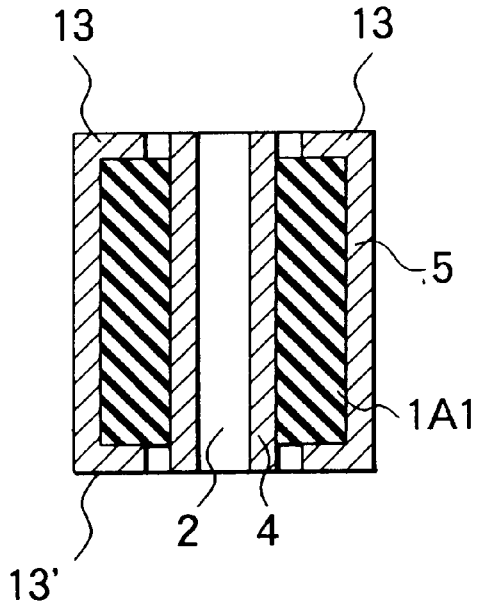
FIG. 9 is a similar sectional view of still another coaxial dielectric resonator according to the second embodiment of this invention.

Variations of the λ /2 resonator will be described with reference to FIGS. 8 and 9. In FIG. 8, the top and the bottom surfaces of the resonator are entirely covered with top and bottom conductors 12 and 12' as short-circuit ends. In FIG. 9, the top and the bottom surfaces are covered with top and bottom conductors 13 and 13' except exposed regions which are formed in the vicinity of the opening edge portion of the through hole 2. Each of the resonators illustrated in FIGS. 8 and 9 acts as a λ /2 resonator and can effectively prevent leakage of an electromagnetic wave because no exposed region is formed (FIG. 8) or the exposed regions are very small (FIG. 9). Referring to FIG. 9, the exposed regions are not necessarily formed in the vicinity of the opening portion of the through hole 2 but may be formed at any appropriate positions as far as the inner and the outer conductors 4 and 5 can be electrically insulated. This approach of forming the exposed regions can be applied to the first embodiment also.

Figure 10:
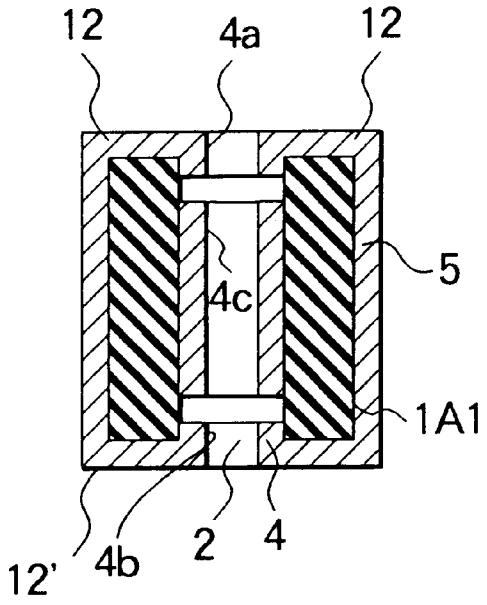
FIG. 10 is a similar sectional view of yet another coaxial dielectric resonator according to the second embodiment of this invention.

Referring to FIG. 10, another variation of the resonator will be described. The inner conductor 4 is divided into three separate portions which will hereafter be referred to as upper, lower, and intermediate conductors 4*a*, 4*b*, and 4*c*. The upper, the lower, and the intermediate conductors 4*a*, 4*b*, and 4*c* cover the inner surface of the dielectric block 1A1 at upper, lower, and intermediate portions thereof, respectively. The top and the bottom surfaces of the dielectric block 1A1 are covered with the top and the bottom conductors 13 and 13', respectively. The first antenna rod 7 is electrically connected to the intermediate conductor 4*c* alone and insulated or isolated from the upper and the lower conductors 4*a* and 4*b*. In order to electrically connect the first antenna rod 7 to the intermediate conductor 4*c* alone, various techniques can be adopted. For example, the surface of the first antenna rod 7 is coated with an insulator film at upper and lower portions corresponding to the upper and the lower conductors 4*a* and 4*b*. Then, the first antenna rod 7 and the intermediate conductor 4*c* are electrically connected by soldering. Alternatively, the first antenna rod 7 having a variable diameter is used. Specifically, the first antenna rod 7 has a smaller diameter at upper and lower portions corresponding to the upper and the lower conductors 4*a* and 4*b* and a greater diameter at a center portion corresponding to the intermediate conductor 4*c*. With this structure, the intermediate conductor 4*c* alone can be electrically connected to the first antenna rod 7 as described above. With the above-mentioned structure, the leakage of the electromagnetic wave can be prevented.

Third Embodiment

Figure 11:
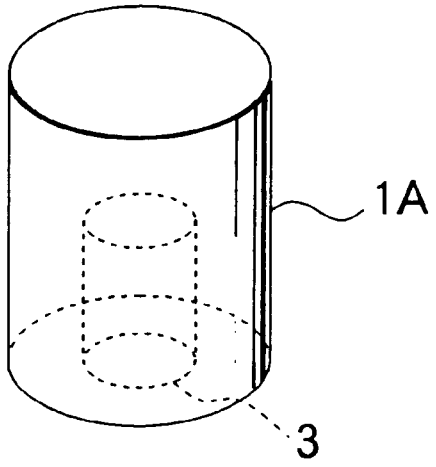
FIG. 11 is a perspective view of a dielectric block in a third embodiment of this invention.
Figure 12:
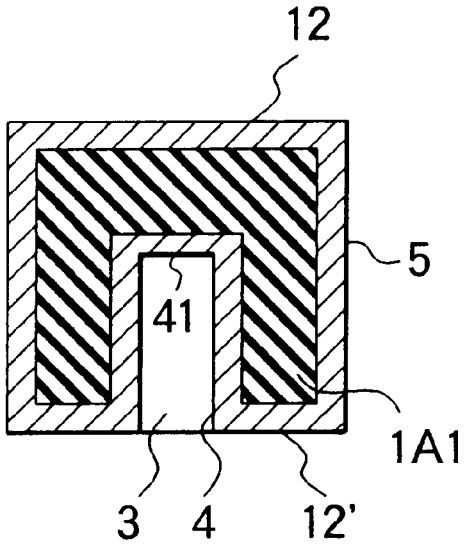
FIG. 12 is a sectional view of a coaxial dielectric resonator according to the third embodiment of this invention.

Now, a third embodiment of this invention will be described with reference to FIGS. 11 and 12.

According to the third embodiment, a trap circuit comprises a λ /4 coaxial dielectric resonator 1A. The structure is basically similar to that of the first embodiment and the following description will be directed to characteristic portions of a multiband antenna according to the third embodiment.

Figure 13:
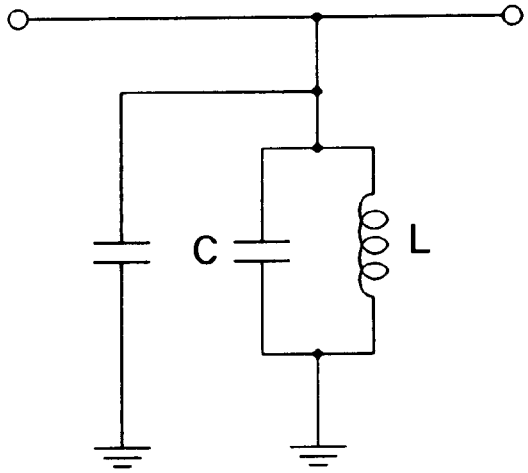
FIG. 13 shows an equivalent circuit for the coaxial dielectric resonator illustrated in FIG. 12.

In the third embodiment, the coaxial dielectric resonator 1A has a dielectric block 1A1 with a center hole 3 which is a dead-end hole. The dielectric block 1A1 is entirely covered with conductors. Specifically, an inner surface and an outer peripheral surface are covered with inner and outer conductors 4 and 5, respectively, while top and bottom surfaces are covered with top and bottom conductors 12 and 12', respectively. In this arrangement, the inner and the outer conductors 4 and 5 are short-circuited by the bottom conductor 12' at the bottom end but are open-circuited at the top end because the hole 3 is the dead-end hole. A first antenna rod 7 is inserted into the dead-end hole 3 of the dielectric block 1A1 until a top end of the first antenna rod 7 is flush with a dead end conductor portion 41 of the inner conductor 4 which portion covers a dead end of the dead-end hole 3. At that position, the first antenna rod 7 is connected by soldering or the like to the inner conductor 4. On the other hand, a second antenna rod 8 has a portion wound around the outer conductor 5 and electrically connected to the outer conductor 5 by soldering or the like. A remaining portion of the second antenna rod 8 extends along an axis of the first antenna rod 7. The second antenna rod 8 is electrically connected through the bottom conductor 12' to the first antenna rod 7. Referring to FIG. 13, it is understood that an equivalent circuit for the coaxial dielectric resonator 1A in the third embodiment comprises an LC parallel resonant circuit and an additional capacitance connected in parallel thereto. Accordingly, in the multiband antenna according to this embodiment, the length of the resonator can be reduced.

According to the third embodiment, it is possible to miniaturize the coaxial dielectric resonator 1A and to prevent the leakage of the electromagnetic wave because the coaxial dielectric resonator 1A is entirely covered with the conductors. In addition, the first antenna rod 7 is easily positioned in place because it is inserted into the dead-end hole 3.

Figure 14:
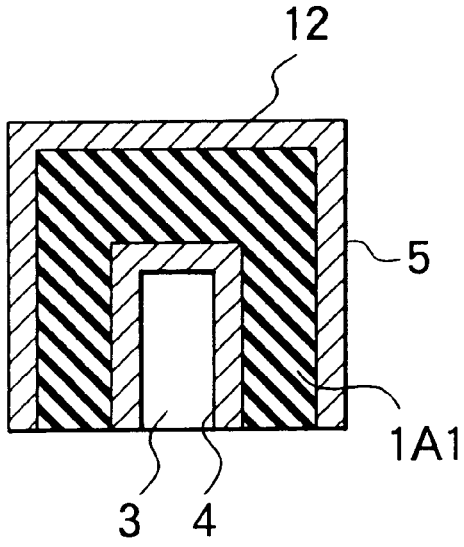
FIG. 14 is a similar sectional view of another coaxial dielectric resonator according to the third embodiment of this invention.
Figure 15:
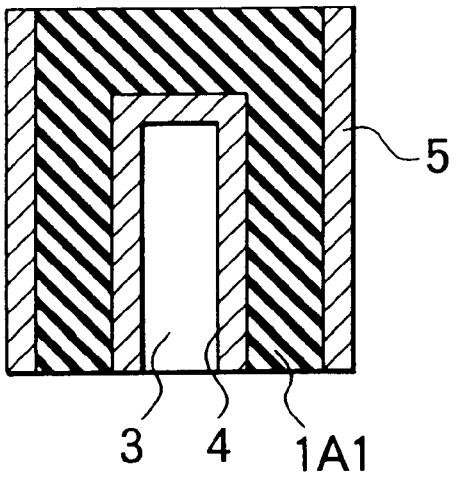
FIG. 15 is a similar sectional view of still another coaxial dielectric resonator according to the third embodiment of this invention.
Figure 16:
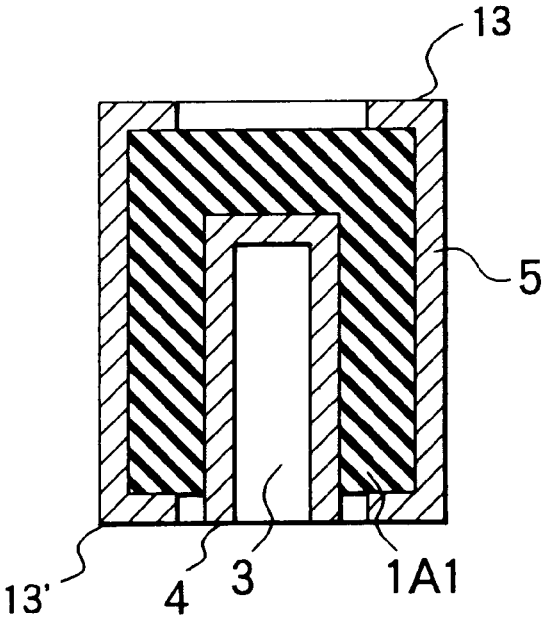
FIG. 16 is a similar sectional view of yet another coaxial dielectric resonator according to the third embodiment of this invention.
Figure 17:
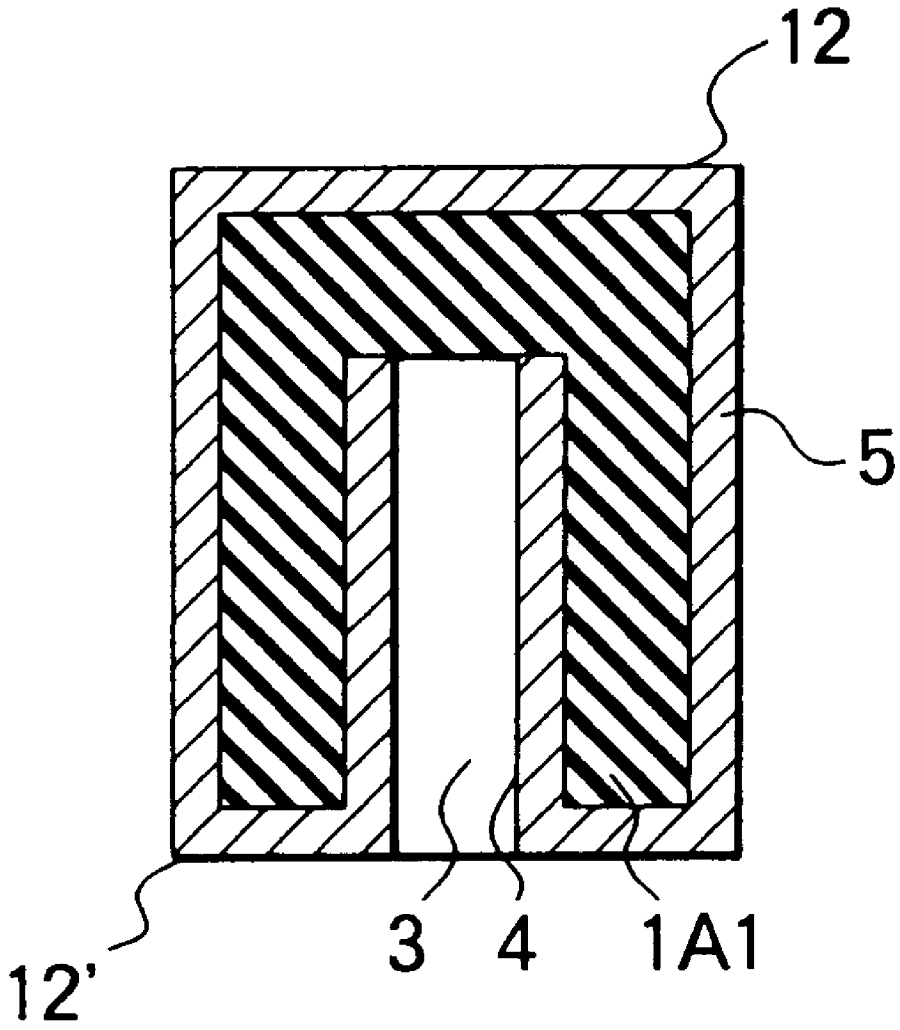
FIG. 17 is a similar sectional view of another coaxial dielectric resonator according to the third embodiment of this invention.

Referring to FIGS. 14 through 17, variations of the resonator having the dead-end hole 3 will be described. Referring to FIG. 14, the dielectric block 1A1 of the coaxial dielectric resonator 1A is entirely covered with the inner, the outer, and the top conductors 4, 5, and 12 except the bottom surface having an opening portion of the dead-end hole 3. Referring to FIG. 15, the dielectric block 1A1 of the coaxial dielectric resonator 1A is entirely covered with the conductors except the bottom and the top surfaces. In other words, the inner surface and the outer peripheral surface of the dielectric block 1A1 are covered with the inner and the outer conductors 4 and 5, respectively. Referring to FIG. 16, the dielectric block 1A1 is entirely covered with the conductors except exposed regions of the top and the bottom surfaces partly covered with conductors 13 and 13', respectively. Referring to FIG. 17, the dielectric block 1A1 is covered with the inner, the outer, the top, and the bottom conductors 4, 5, 12, and 12' except that part of the inner surface which defines the dead end of the dead-end hole 3. The structure of FIG. 17 can be applied to the coaxial dielectric resonators 1A illustrated in FIGS. 14 through 16.

Fourth Embodiment

Next, a fourth embodiment of this invention will be described with reference to FIGS. 18 and 19.

The fourth embodiment is particularly related to the configuration of a second antenna rod.

Figure 18:
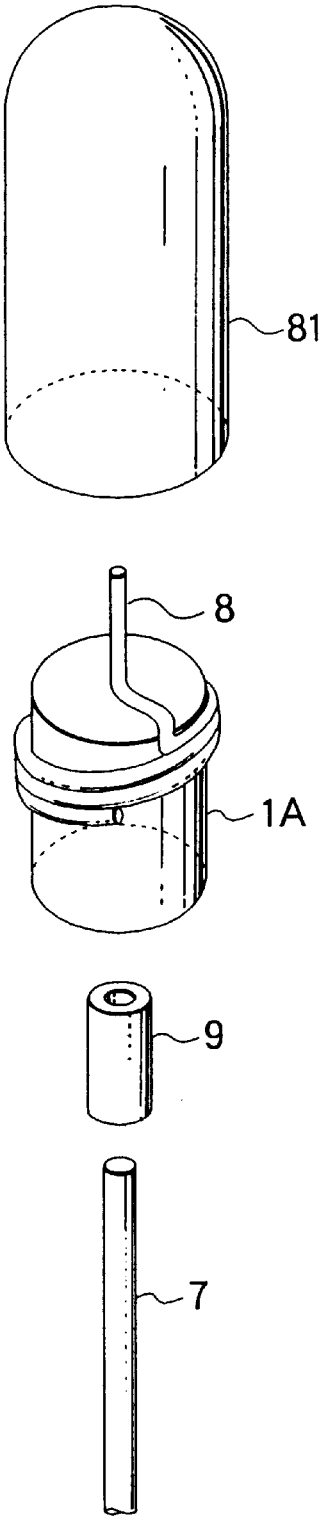
FIG. 18 is an exploded perspective view showing a structure around the dielectric resonator in the first through the third embodiments of this invention.
Figure 19:
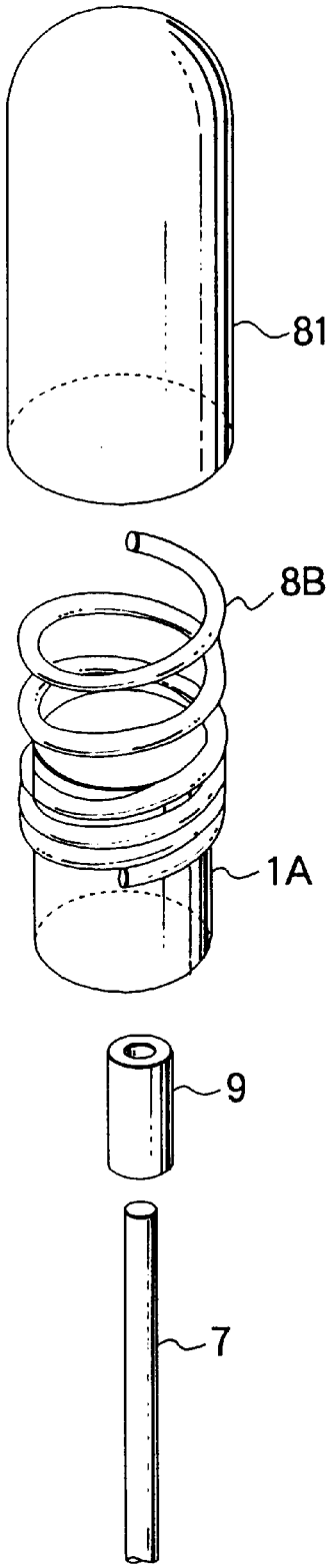
FIG. 19 is an exploded perspective view showing a structure around a dielectric resonator in a fourth embodiment of this invention.

In comparison with the fourth embodiment, the structure around the coaxial dielectric resonator 1A of the multiband antenna in the first through the third embodiments is specifically shown in FIG. 18 as a perspective view. It should be noted that the second antenna rod 8 has a portion wound around the outer periphery of the coaxial dielectric resonator 1A and the remaining portion of the second antenna rod 8 extends along a center axis of the dielectric block 1A1.

On the other hand, according to the fourth embodiment, a second antenna rod 8B comprises a helical coil element. The second antenna rod 8B as the helical coil element has an inner diameter substantially equal to an outer diameter of the coaxial dielectric resonator 1A. The second antenna rod 8B has a portion wound around the outer periphery of the coaxial dielectric resonator 1A and connected by soldering or the like to the outer conductor 5. The remaining portion of the second antenna rod 8B as the helical coil element upwardly extends with its axis coincident with the axis of the first antenna rod 7.

Fifth Embodiment

A fifth embodiment relates to the configuration of a sleeve 9.

If a first antenna rod 7 is formed by a superelastic metal, soldering is generally impossible and plating is difficult. Accordingly, electrical connection between a conductor covering a dielectric block 1A1 and the first antenna rod 7 is often difficult to perform.

Figure 20:
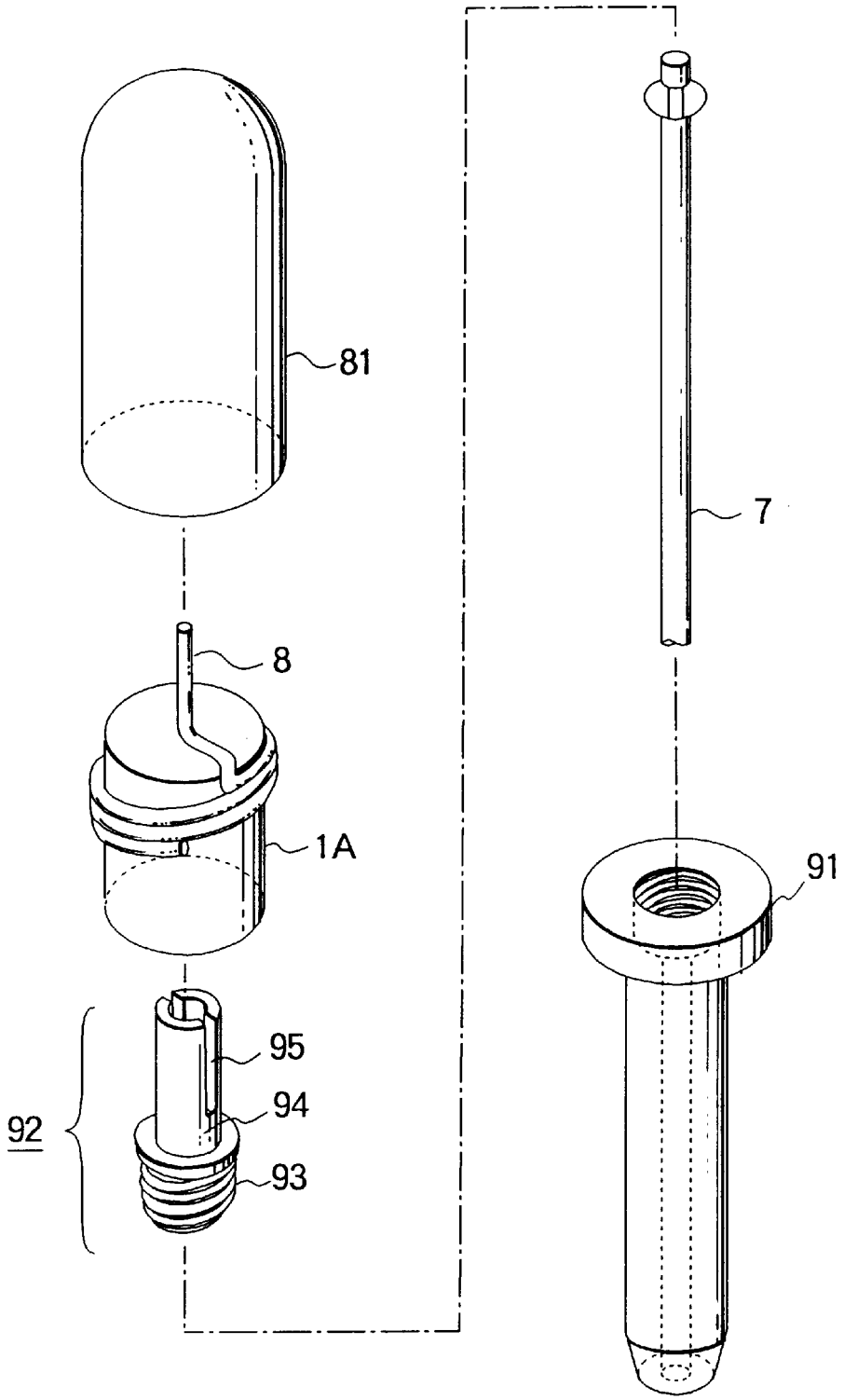
FIG. 20 is an exploded perspective view showing a structure around a dielectric resonator in a fifth embodiment of this invention.
Figure 21:
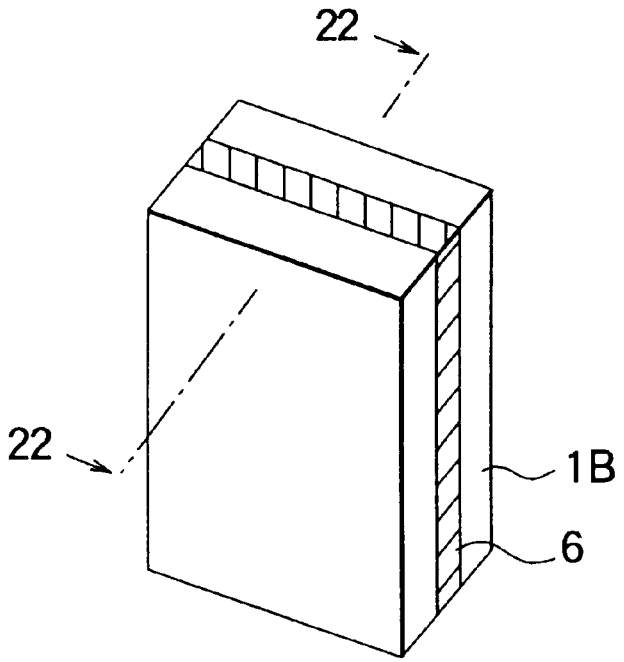
FIG. 21 is a perspective view of a triplate dielectric resonator according to a sixth embodiment of this invention.
Figure 22:
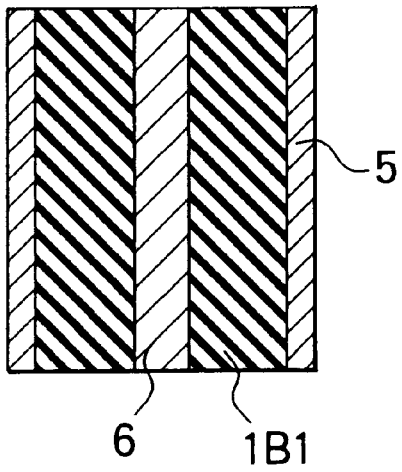
FIG. 22 is a sectional view of the triplate dielectric resonator according to the sixth embodiment of this invention taken along a line 22–22 in FIG. 21.
Figure 23:
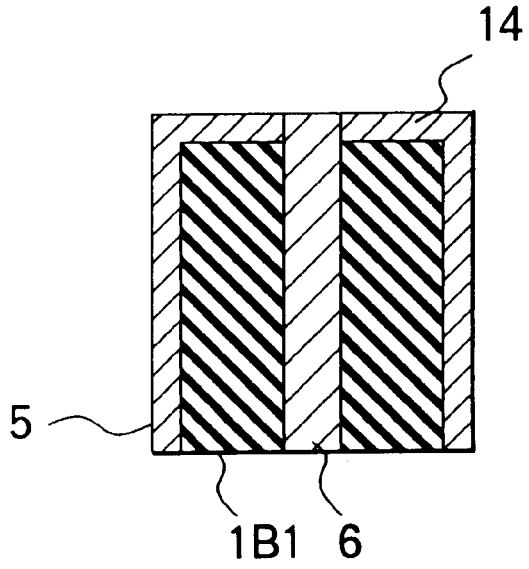
FIG. 23 is a similar sectional view of another triplate dielectric resonator according to the sixth embodiment of this invention.
Figure 24:
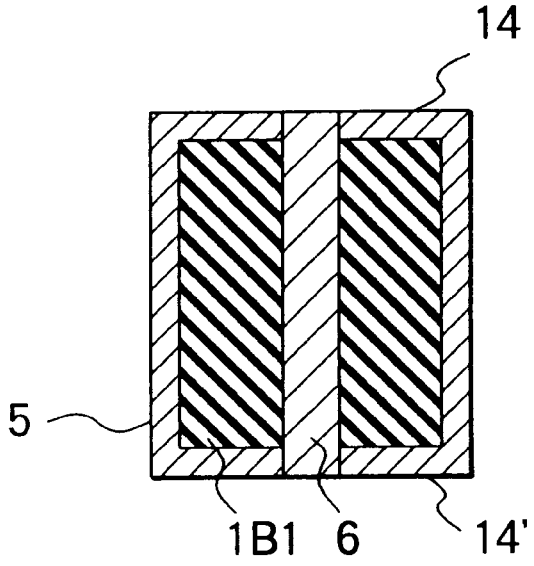
FIG. 24 is a similar sectional view of still another triplate dielectric resonator according to the sixth embodiment of this invention.
Figure 25:
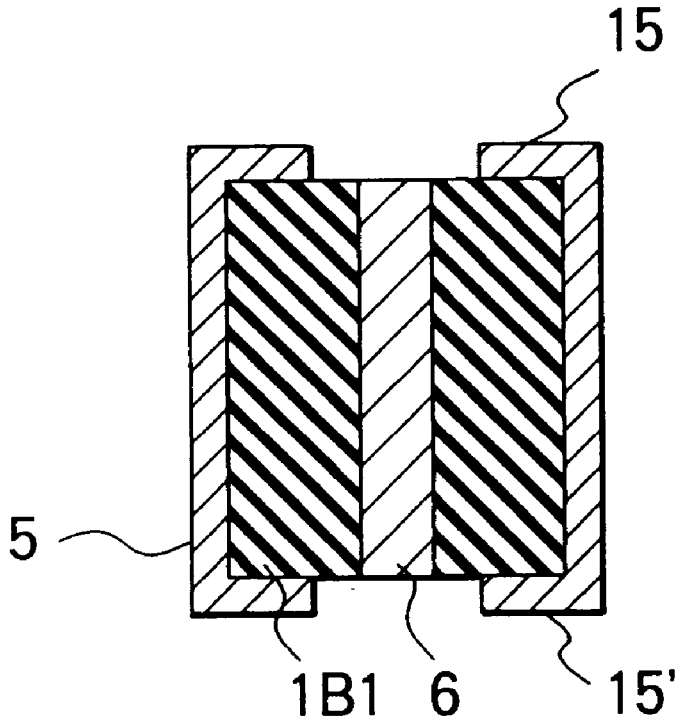
FIG. 25 is a similar sectional view of yet another triplate dielectric resonator according to the sixth embodiment of this invention.

As a structure useful in the above-mentioned case, the sleeve 9 in this embodiment comprises a base member 91 and a coupling member 92 shown in FIG. 20.

According to the fifth embodiment, the first antenna rod 7 made of a superelastic metal is partly deformed, press-fitted into the sleeve 9, and fixedly coupled thereto. Electrical connection is achieved between the first antenna rod 7 and the inner conductor 4 through the sleeve 9.

The sleeve 9 is preferably made of phosphor bronze to provide a spring characteristic.

More specifically, the base member 91 is internally threaded. The coupling member 92 has an externally-threaded portion 93 to be screwed into the base member 91. The coupling member 92 further has a press-fit portion 94 to be connected to the inner conductor 4 and a slit 95 formed in the press-fit portion 94. Thus, the press-fit portion 94 can be deformed to be press-fitted into a center hole of the coaxial dielectric resonator 1A. To assure a greater coupling strength, soldering can be used in addition to press-fit contact. The first antenna rod 7 is press-fitted into the base member 91 to be fixedly coupled. Thereafter, the base member 91 and the coupling member 92 are screwed together.

The structure of the fifth embodiment can be combined with that of the above-mentioned fourth embodiment.

Sixth Embodiment

Now, a multiband antenna according to the sixth embodiment will be described with reference to FIGS. 21 through 25.

The multiband antenna according to the sixth embodiment comprises a triplate dielectric resonator 1B. Basically, the sixth embodiment has a structure similar to that of the first embodiment except the coaxial dielectric resonator 1A is replaced by the triplate dielectric resonator 1B.

The triplate dielectric resonator 1B comprises two dielectric ceramic plates 1B1 each of which has inner and outer principal surfaces, a center conductor 6 interposed between the inner principal surfaces of the dielectric ceramic plates 1B1, and outer conductors 5 covering the outer principal surfaces. Top and bottom surfaces of the dielectric ceramic plates 1B1 are covered with top and bottom conductors 14 and 14' or 15 and 15' as appropriate. In the sixth embodiment, the center conductor 6 and the first antenna rod 7 can be integrally formed by a copper plate or the like. It is noted here that the structure of the fourth embodiment described above can be applied to the sixth embodiment.

Also in the coaxial dielectric resonator 1A in the foregoing embodiments, the inner conductor 4 and the first antenna rod 7 can be integrally formed.

In all of the foregoing embodiments, the outer conductors 5 and the second antenna rod 8 can be integrally formed.

In case where the inner conductor 4 is electrically connected to the outer conductors 5, the inner conductor 4 and the first and the second antenna rods 7 and 8 can be integrally formed. Similarly, in case where the center conductor 6 is electrically connected to the outer conductors 5, the center conductor 6 and the first and the second antenna rods 7 and 8 can be integrally formed.

By the use of the multiband antenna according to any one of the foregoing embodiments, it is possible to achieve a small-sized portable radio apparatus.

For reference, experimental data will hereafter be given with respect to the above-mentioned embodiments.

In the first embodiment, the coaxial dielectric resonator comprises a cylindrical block of $TiO_2$-BaO-based dielectric ceramics. The dielectric ceramics has a relative dielectric constant $\epsilon_r$ equal to 115. The block has a length $\ell_d$ equal to 4 mm for 1900 MHz. Each of the first and the second antenna rods comprises a nickel-plated piano wire. The first antenna rod has a diameter $\phi_{a1}$ equal to 0.8 mm which is slightly smaller than the inner diameter (corresponding to the diameter of the center hole) $\phi_{d1}$ of the block which is equal to 0.85 mm.

In the second embodiment, the dielectric ceramics has a relative dielectric constant $\epsilon_r$ equal to 115. The block has a length $\ell_d$ equal to 8 mm for 1900 MHz.

The superelastic metal used as a material of the first antenna rod is an Ni—Ti based alloy.

In the embodiments, the first and the second antenna rods and the dielectric resonator are molded in polyolefin-based elastomer. Alternatively, use may be made of polymer.

What is claimed is:

1. A multiband whip antenna comprising:

a metal radiation element; and a distributed-constant coaxial dielectric resonator;

wherein said distributed-constant coaxial dielectric resonator includes: (i) a dielectric block having a center hole, (ii) a first conductor covering an inner surface of said dielectric block, said inner surface defining said center hole, and (iii) a second conductor covering an outer peripheral surface of said dielectric block;

wherein said metal radiation element comprises first and second antenna rods, said first antenna rod being electrically connected to said first conductor of said distributed-constant coaxial dielectric resonator, and said second antenna rod being electrically connected to said second conductor of said distributed-constant coaxial dielectric resonator; and wherein said second antenna rod comprises a helical coil element.

2. A multiband whip antenna as claimed in claim 1, wherein said distributed-constant coaxial dielectric resonator is operable in at least one of a $\lambda/2$ TEM mode and a $\lambda/4$ TEM mode.

3. A multiband whip antenna as claimed in claim 1, wherein:

said distributed-constant coaxial dielectric resonator further comprises a third conductor covering at least one of top and bottom surfaces of said dielectric block; and said first and said second conductors are electrically connected by said third conductor.

4. A multiband whip antenna as claimed in claim 1, wherein:

said distributed-constant coaxial dielectric resonator further comprises a third conductor covering at least one of top and bottom surfaces of said dielectric block except in at least one predetermined region; and said first and said second conductors are electrically isolated from each other without being connected by said third conductor.

5. A multiband whip antenna as claimed in claim 1, wherein said center hole comprises a through hole.

6. A multiband whip antenna as claimed in claim 1, wherein said center hole comprises a dead-end hole.

7. A multiband whip antenna as claimed in claim 1, wherein said first antenna rod comprises a superelastic metal.

8. A multiband whip antenna as claimed in claim 1, wherein:

said multiband antenna further comprises a sleeve connecting said first conductor and said first antenna rod;

said sleeve is at least partially made of an elastic metal and has a press-fit portion press-fitted into said center hole of said distributed-constant coaxial dielectric resonator so as to be electrically and mechanically connected to said first conductor; and said press-fit portion includes one of a slit and gap for allowing elastic deformation.

9. A multiband whip antenna as claimed in claim 1, wherein said second antenna rod and said distributed-constant coaxial dielectric resonator are molded in an insulating material.

10. A multiband whip antenna as claimed in claim 9, wherein said insulating material comprises one of a flexible polymer and a flexible elastomer.

11. A multiband whip antenna comprising:

a metal radiation element; and a distributed-constant triplate dielectric resonator;

wherein said distributed-constant triplate dielectric resonator includes: (i) two dielectric plates each of which has a first principal surface and a second principal surface opposite to each other, (ii) a first conductor interposed between said first principal surfaces of said two dielectric plates, and (iii) second conductors covering said second principal surfaces of said dielectric plates;

wherein said metal radiation element comprises first and second antenna rods, said first antenna rod being electrically connected to said first conductor of said distributed-constant triplate dielectric resonator, and said second antenna rod being electrically connected to said second conductors of said distributed-constant triplate dielectric resonator; and wherein said second antenna rod comprises a helical coil element.

12. A multiband whip antenna as claimed in claim 11, wherein said distributed-constant triplate dielectric resonator is operable in at least one of a $\lambda/2$ TEM MODE and a $\lambda/4$ TEM mode.

13. A multiband whip antenna as claimed in claim 11, wherein said distributed-constant triplate dielectric resonator comprises:

two dielectric plates each of which has a first principal surface and a second principal surface opposite to each other;

a first conductor interposed between said first principal surfaces of said two dielectric plates; and second conductors covering said second principal surfaces of said dielectric plates.

14. A multiband whip antenna as claimed in claim 13, wherein:

said distributed-constant triplate dielectric resonator further comprises a third conductor covering at least one of a pair of opposite surfaces among four side surfaces of each of said dielectric plates other than said principal surfaces; and said first and said second conductors are electrically connected by said third conductor.

15. A multiband whip antenna as claimed in claim 13, wherein:

said distributed-constant triplate dielectric resonator further comprises a third conductor covering, except for at least one predetermined region, at least one of a pair of opposite surfaces among four side surfaces of each of said dielectric plates other than said principal surfaces; and said first and said second conductors are electrically isolated from each other without being connected by said third conductor.

16. A multiband whip antenna as claimed in claim 11, wherein said first antenna rod comprises a superelastic metal.

17. A multiband whip antenna as claimed in claim 11, wherein said second antenna rod and said distributed-constant triplate dielectric resonator are molded in an insulating material.

18. A multiband whip antenna as claimed in claim 17, wherein said insulating material comprises one of a flexible polymer and a flexible elastomer.

19. A multiband whip antenna as claimed in claim 11, wherein said first conductor and said first antenna rod are integrally formed.

20. A multiband whip antenna as claimed in claim 11, wherein said second conductors and said second antenna rod are integrally formed.

* * * * *